US006171268B1

(12) United States Patent
Zhadanov

(10) Patent No.: US 6,171,268 B1
(45) Date of Patent: Jan. 9, 2001

(54) ATTACHMENT FOR A ROTATABLE DEVICE FOR WASHING, CLEANING, MASSAGING, ETC.

(76) Inventor: Eli Zhadanov, 2944 W. 5th St., Apt. 20J, Brooklyn, NY (US) 11224

( * ) Notice: Under 35 U.S.C. 154(b), the term of this patent shall be extended for 0 days.

(21) Appl. No.: 09/161,360

(22) Filed: Sep. 28, 1998

(51) Int. Cl.[7] ..... A61H 33/00

(52) U.S. Cl. ..... 601/112; 601/114; 601/154

(58) Field of Search ..... 601/55, 85, 88, 601/96, 105, 154, 155, 156, 160, 159, 75, 76, 112, 114, 118, 119, 120, 139, 141, 142, 17–20; 15/22.1, 22.2, 23, 24, 25, 28, 29, 34, 52.1, 97.1; 4/559; 239/200, 416.4, 417

(56) References Cited

U.S. PATENT DOCUMENTS

| | | | | |
|---|---|---|---|---|
| 500,415 | * | 6/1893 | Neal | 15/23 |
| 861,610 | * | 7/1907 | Sarver | 601/160 |
| 2,506,487 | * | 5/1950 | Burns | 15/24 |
| 2,905,171 | * | 9/1959 | Crescenzo | 601/105 |
| 3,121,537 | * | 2/1964 | Canton | 601/105 |
| 3,370,583 | * | 2/1968 | Teranishi | 601/16 |
| 3,813,721 | * | 6/1974 | Gaudio | 15/29 |
| 4,151,624 | * | 5/1979 | Montalvo | 15/23 |
| 4,458,676 | * | 7/1984 | Pileggi | 601/105 |
| 4,485,807 | * | 12/1984 | Gueret | 601/154 |
| 4,532,666 | * | 8/1985 | Smyth | 15/29 |
| 4,964,398 | * | 10/1990 | Jones | 15/22.1 |
| 5,007,127 | * | 4/1991 | Paolo | 15/29 |
| 5,054,474 | * | 10/1991 | Jacob et al. | 601/160 |
| 5,129,121 | * | 7/1992 | Gelman | 15/29 |
| 5,187,827 | * | 2/1993 | Wei | 15/22.1 |
| 5,385,532 | * | 1/1995 | Shyu | 601/154 |
| 5,862,558 | * | 1/1999 | Gifinger et al. | 15/22.1 |
| 5,909,754 | * | 6/1999 | Oh | 15/29 |

FOREIGN PATENT DOCUMENTS

| | | | | |
|---|---|---|---|---|
| 94018929 | * | 9/1994 | (WO) | 601/160 |

* cited by examiner

*Primary Examiner*—Justine R. Yu
(74) *Attorney, Agent, or Firm*—I. Zborovsky

(57) ABSTRACT

An attachment to a water driven rotatable device for washing, cleaning, massaging, etc., comprising an attachment element having an axis and including a substantially cylindrical portion which is open at one side and engageable with the water driven rotatable device, an intermediate portion provided with a plurality of passages for passing of water there through, and a tail portion located opposite to the substantially cylindrical portion, and a plurality of inserts each connectable with the tail portion of the attachment element, each of the inserts having a holding portion attachable to the tail portion of the attachment element and a working portion connected with the holding portion and arranged so that water passing through the throughgoing passages of the intermediate portion of the attachment elements acts on the working portion.

9 Claims, 4 Drawing Sheets

ATTACHMENT FOR A ROTATABLE DEVICE FOR WASHING, CLEANING, MASSAGING, ETC.

BACKGROUND OF THE INVENTION

The present invention relates to an attachment for a rotatable device for washing, cleaning, massaging, etc.

Devices of the above mentioned general type are known in the art. It is advisable to further improve the existing devices so that various attachments can be attached to them easily and provide efficient washing, cleaning, massaging, etc.

SUMMARY OF THE INVENTION

Accordingly, it is an object of present invention to provide an attachment element for a rotatable device for washing, cleaning, massaging, and the like which is a further improvement of the existing devices.

In keeping with these objects and with others which will become apparent hereinafter, one feature of present invention resides, briefly stated, in an attachment element having an axis and including a substantially cylindrical portion which is open at one side and engageable with the water driven rotatable device, an intermediate portion provided with a plurality of passages for passing of water there through, and a tail portion located opposite to said substantially cylindrical portion; and a plurality of inserts each connectable with said tail portion of said attachment element, each of said inserts having a holding portion attachable to said tail portion of said attachment element and a working portion connected with said holding portion and arranged so that water passing through said throughgoing passages of said intermediate portion of said attachment elements acts on said working portion.

When the attachment is designed in accordance with the present invention, various inserts can be interchangeably attached to the same fluid-driven rotatable device while performing corresponding operations.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
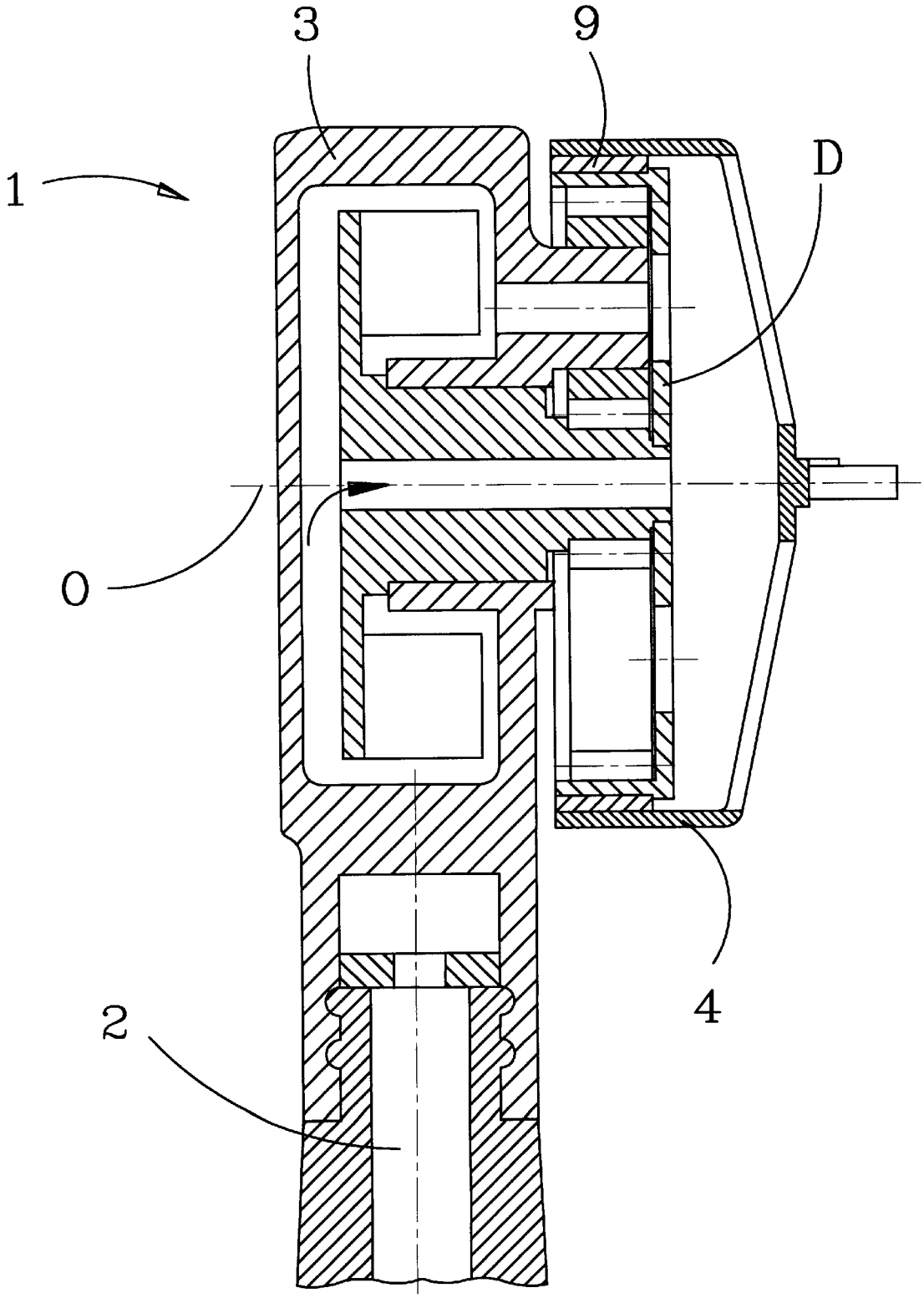
FIG. 1 is a view showing an attachment in accordance with present invention.
Figure 2:
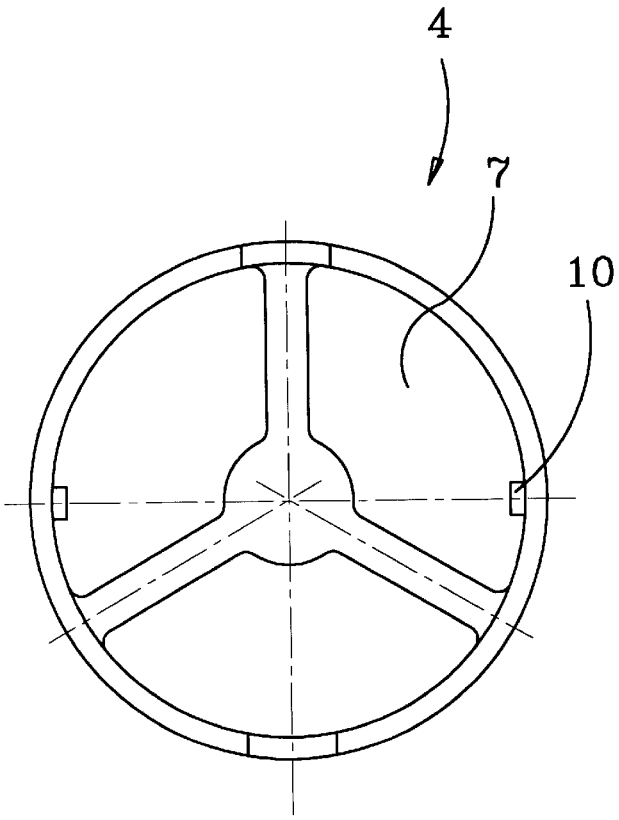
FIGS. 2 and 3 are a side view and a front view of an attachment element of the inventive attachment.
Figure 3:
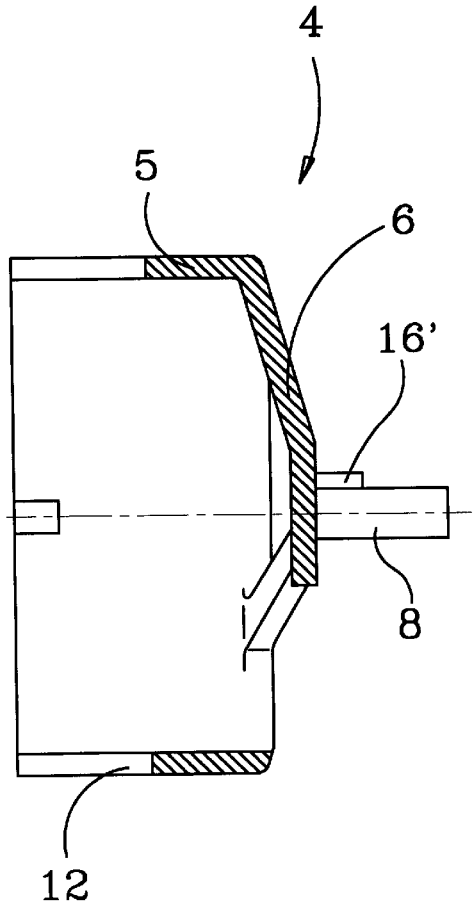
Figure 4:
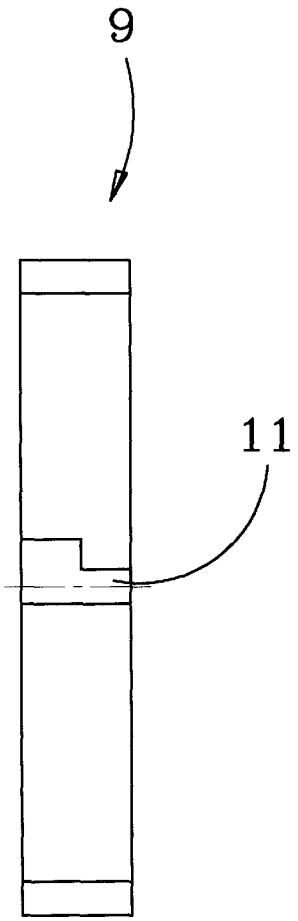
FIGS. 4 and 5 are a side view and a front view of a ring insertable in the attachment element.
Figure 5:
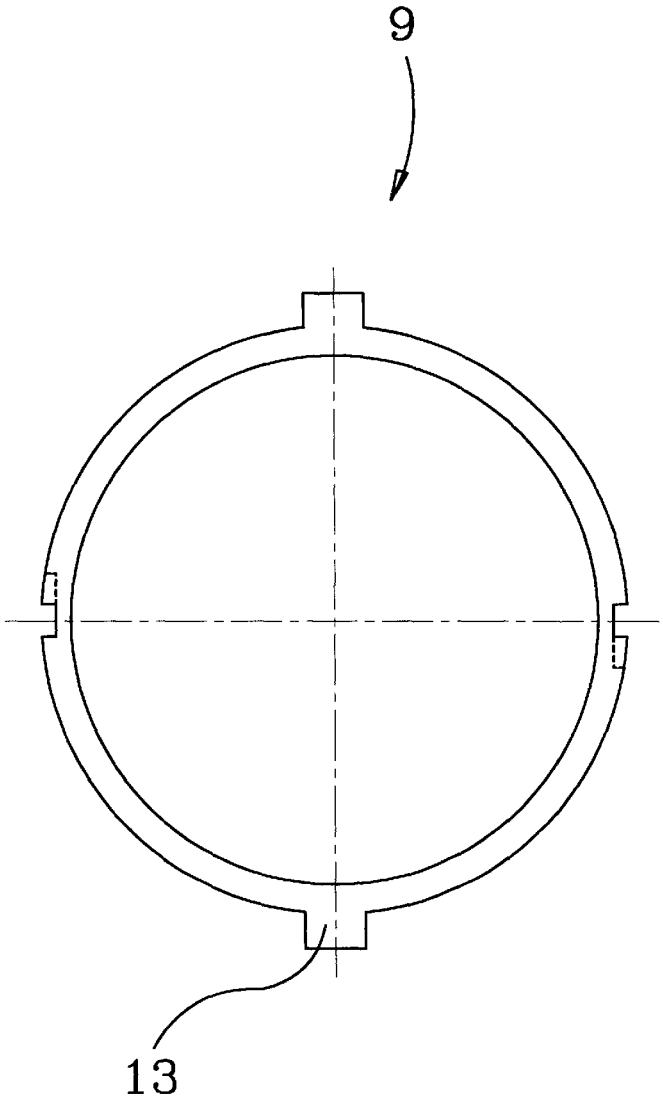

An attachment in accordance with the present invention is used for a rotatable water driven device which is identified as a whole with reference numeral 1. The water driven device has a conduit 2 for supplying water, and a housing 3 which communicates with the conduit 2 and accommodates a rotor. Water passes through the conduit 2, enters the housing 3, impinges on vanes of the rotor and rotates the same around an axis O. A disc D supports gears of a transmission.

An attachment in accordance with the present invention has an attachment element which is identified as a whole with reference numeral 4. The attachment element includes a substantially cylindrical open portion 5, an intermediate portion 6 provided with a plurality of throughgoing passages 7, and a tail portion 8 which is located opposite to the substantially cylindrical portion 5 and extends in an axle direction. A ring 9 is inserted in the cylindrical portion 5 of the attachment element 4. The ring 9 is connected with the cylindrical portion 5 by cooperation of a projections 10 provided in the cylindrical portion 5 and L-shaped grooves 11 provided in the ring 9, as well as by the cooperation of slots 12 provided in the cylindrical portion 5 and projections 13 provided on the ring 9. The first connecting elements are located in the center of the cooperating parts while the second connecting elements are located on the periphery of the same. Therefore the components 4 and 9 can be assembled by their initial engagement and then turning relative to one another. The ring 9 is fitted on an outer surface of the water-driven device.

Figure 6A:
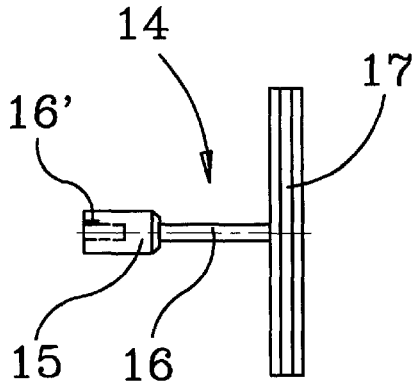
FIG. 6 is a view showing a working insert in accordance with one embodiment of the present invention.
Figure 6B:
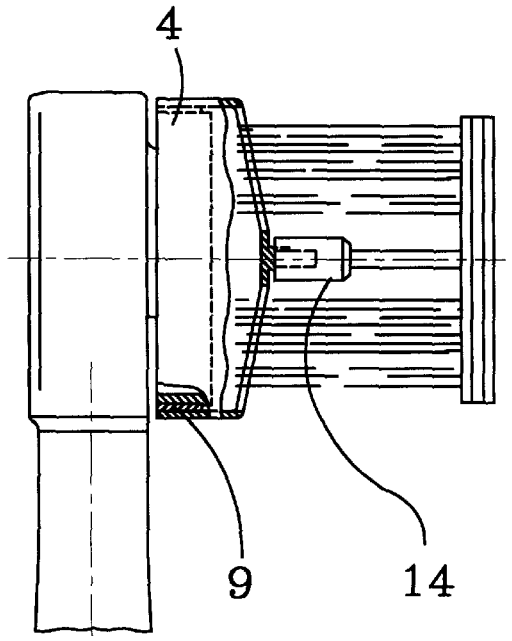

The attachment is further provided with a plurality of inserts. One of such inserts 14 is shown in FIG. 6. The insert includes a holding element 15 which is provided with a formation 16 connectable with a formation 16' of the attachment element 4. The holding portion 15 is connected by a rod 16 with a working portion. The working portion is as a disc formed of a material suitable for a corresponding treatment. For example, for massaging, at least the working surface of the disc 17 facing away from the holding portion 15 is composed of a material suitable for massaging.

The attachment operates in the following manner:

When a liquid is supplied through the fluid-driven device, the attachment element 4 is rotated, and the insert 14 is rotated as well. Water passes through a peripheral gap between the disc D and the ring 9, and then through the passages 17 of the attachment element 4 and applies a pressure on the rear surface of the disc 7 so as to press the disc 17 toward a surface to be treated, such as a part of a user's body. Therefore the disc 17 is brought in contact with the user's body, is rotated being in contact with the user's body, and water is also applied to the user's body. It is to be understood that a working medium can be not only water but also another liquid or gas.

Figure 7:
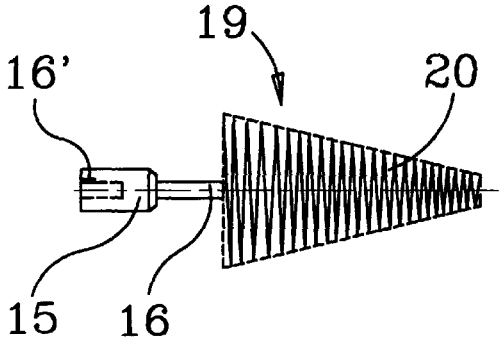
FIG. 7 is a view showing working insert in accordance with another embodiment of the present invention.

Another attachment 19 is shown in FIG. 7. The attachment has the same holding portion 15 with the formation 16 and a rod portion 17 which however connects the holding element 15 with a brush 20. The attachment 19 is designed for washing of deep recesses, such as vehicle hubcaps, drain pipes in households, etc. Under the action of fluid, the attachment element is rotated, and rotates the insert 19. Water which passes through the attachment element impinges on bristles of the brush 20 so as to produce a hydraulic pressure. The brush 20 is rotated, and deep recess devices are washed due to the hydraulic pressure. The brush 20 is conical, and therefore it can be easily introduced into narrow holes and abut against its walls.

It will be understood that each of the elements described above, or two or more together, may also find a useful application in other types of constructions differing from the types described above.

While the invention has been illustrated and described as embodied in attachment for a rotatable device for washing, cleaning, massaging, etc, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An attachment connectable to a water driven rotatable device for washing, cleaning, massaging and the like rotatively relative to the device, comprising an attachment element having an axis and including a substantially cylindrical hollow portion which is open at one axial side and engageable with the water driven rotatable device so as to rotate relative to the latter, an intermediate portion extending substantially transversely to said axis and provided with a plurality of passages for passing of water there through which are rotatable during rotation of the attachment element and which extend transversely to said axis substantially over a whole transverse dimension of said intermediate portion, and a tail portion located axially opposite to said substantially cylindrical portion exclusively in a center of said intermediate portion in a region of said axis between said passages; and a plurality of inserts each connectable with said tail portion of said attachment element, each of said inserts having a holding portion located exclusively in a region of said axis and attachable to said tail portion of said attachment element, and a working portion axially spaced from said holding portion and connected with said holding portion and having a rear side which faces toward said passages and extends transversely to said axis, so that water passing through said throughgoing passages of said intermediate portion of said attachment element substantially over a whole transverse direction of said intermediate portion acts on substantially a whole transverse side of said working portion axially spaced from said holding portion and of each of said inserts; and means for connecting said attachment element with the water driven rotatable device so that said attachment element including said cylindrical, intermediate and tail portions and also each of said inserts including said holding portion an said working portion axially spaced from said holding portion are rotatable relative to the water driven device, but each of said inserts is non-rotatably connected with said attachment element.

2. An attachment as defined in claim 1, and further comprising a ring located inside said substantially cylindrical portion of said attachment element, said ring being form-lockingly connected with said substantially cylindrical portion and engageable with the water driven device.

3. An attachment as defined in claim 1, wherein said passages of said intermediate portion on said attachment element are spaced from one another in a circumferential direction of said attachment element.

4. An attachment as defined in claim 1, and further comprising form-locking means for connecting said tail portion of said attachment element with said holding portion of each of said inserts, said form-locking means including cooperation formations provided on said tail portion of said attachment element and on said holding portion of each of said inserts.

5. An attachment as defined in claim 1, wherein said working portion of one of said inserts is formed as a disc having a front surface adapted to face a part to be treated and a rear surface facing said attachment element and arranged so that water passing through said passages applies a pressure on said rear surface to press said disc against the part to be treated.

6. An attachment as defined in claim 1, wherein said working portion of one of said inserts is formed as a brush arranged so that water passing through said passages of said attachment element is applied to said brush.

7. An attachment as defined in claim 1, wherein said brush has a conical shape.

8. An attachment as defined in claim 1; and further comprising a ring located inside said substantially cylindrical hollow portion of said attachment element, said ring being form-lockingly connected with said substantially cylindrical hollow portion and engageable with the water driven device; and means for form-lockingly connecting said ring with said substantially cylindrical portion of said attachment element and including an L-shaped groove provided on one of said ring and said substantially cylindrical hollow portion and a projection provided on the other of said ring and said substantially cylindrical hollow portion.

9. An apparatus for washing, cleaning, massaging and the like, comprising a water driven rotatable device; an attachment element having an axis and including a substantially cylindrical hollow portion which is open at one axial side and engageable with the water driven rotatable device so as to rotate relative to the latter, an intermediate portion extending substantially transversely to said axis and provided with a plurality of passages for passing of water there through which are rotatable during rotation of the attachment element and which extend transversely to said axis substantially over a whole transverse dimension of said intermediate portion, and a tail portion located axially opposite to said substantially cylindrical portion exclusively in a center of said intermediate portion in a region of said axis between said passages; and a plurality of inserts each connectable with said tail portion of said attachment element, each of said inserts having a holding portion located exclusively in a region of said axis and attachable to said tail portion of said attachment element, and a working portion axially spaced from said holding portion and connected with said holding portion and having a rear side which faces toward said passages and extends transversely to said axis, so that water passing through said throughgoing passages of said intermediate portion of said attachment element substantially over a whole transverse dimension of said intermediate portion acts on substantially a whole transverse side of said working portion axially spaced from said holding portion and of each of said inserts; and means for connecting said attachment element with the water driven rotatable device so that said attachment element including said cylindrical, intermediate and tail portions and also each of said inserts including said holding portion and said working portion are rotatable relative to the water driven device, but each of said inserts is non-rotatably connected with said attachment element.

* * * * *